United States Patent [19]

Bernot

[11] 4,175,412

[45] Nov. 27, 1979

[54] PROCESS AND INSTALLATION FOR MECHANICAL DESCALING STEEL WIRE

[75] Inventor: Jean Bernot, Saint-Dizier, France

[73] Assignee: Trefilunion, Saint-Dizier, France

[21] Appl. No.: 885,160

[22] Filed: Mar. 10, 1978

[30] Foreign Application Priority Data

Mar. 11, 1977 [FR] France ..... 77 07579

[51] Int. Cl.[2] ..... B21B 45/04; B24C 3/12

[52] U.S. Cl. ..... 72/40; 29/81 F; 29/81 K; 51/5 A; 51/320

[58] Field of Search ..... 29/81 R, 81 F, 81 K; 51/5 A, 9 R, 319, 324, 320; 72/39, 40

[56] References Cited

U.S. PATENT DOCUMENTS

| | | | |
|---|---|---|---|
| 3,055,150 | 9/1962 | Greenberg et al. | 51/319 X |
| 3,097,451 | 7/1963 | Freeman et al. | 51/319 X |
| 3,628,295 | 12/1971 | Curtiss | 51/319 |
| 3,977,128 | 8/1976 | Goff | 51/319 X |

FOREIGN PATENT DOCUMENTS

| | | | |
|---|---|---|---|
| 2401626 | 1/1975 | Fed. Rep. of Germany | 72/40 |
| 498999 | 4/1976 | U.S.S.R. | 72/40 |

*Primary Examiner*—E. M. Combs

*Attorney, Agent, or Firm*—Sughrue, Rothwell, Mion, Zinn and Macpeak

[57] ABSTRACT

Descaling of metal wire by bending is followed by projection of the scale from the wire. The scale, projected by nozzles in a descaling device, is a mixture of new scale coming directly from the wire undergoing the bendings and scale recycled several times by a recycle feedback path. This application is applicable to the treatment of steel wire known as "rod" coming from hot rolling.

9 Claims, 3 Drawing Figures

Figure 3:
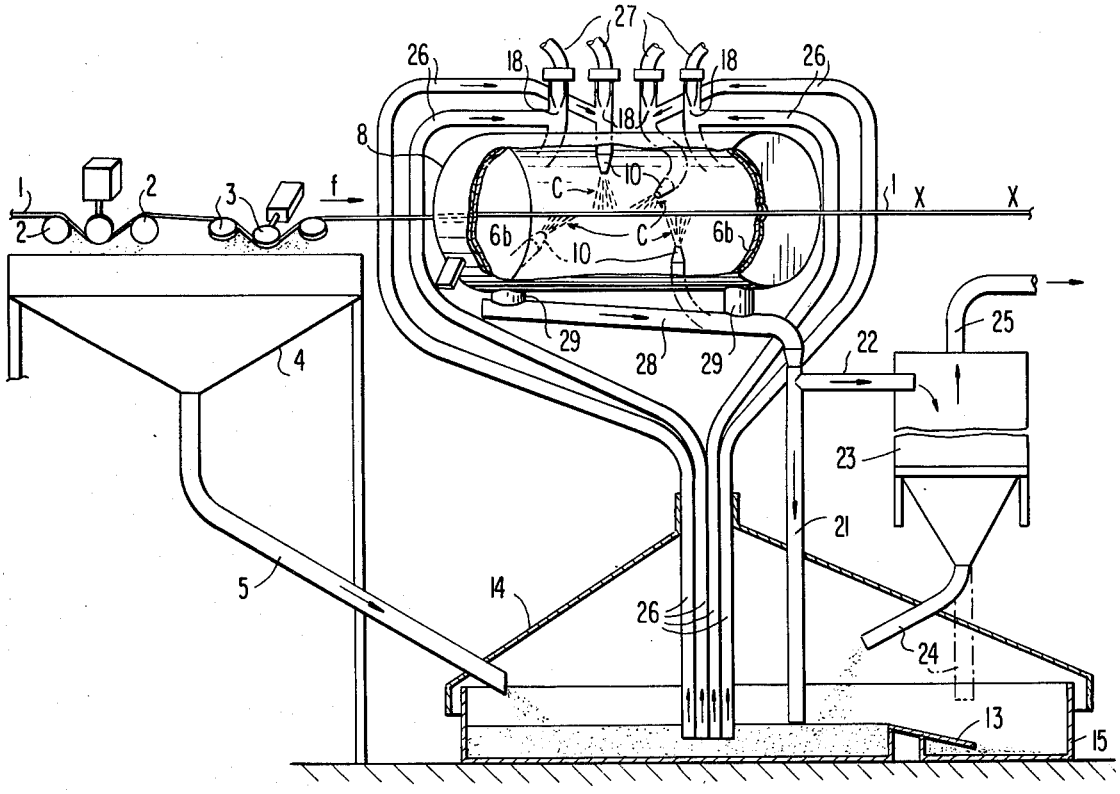

FIG. 1
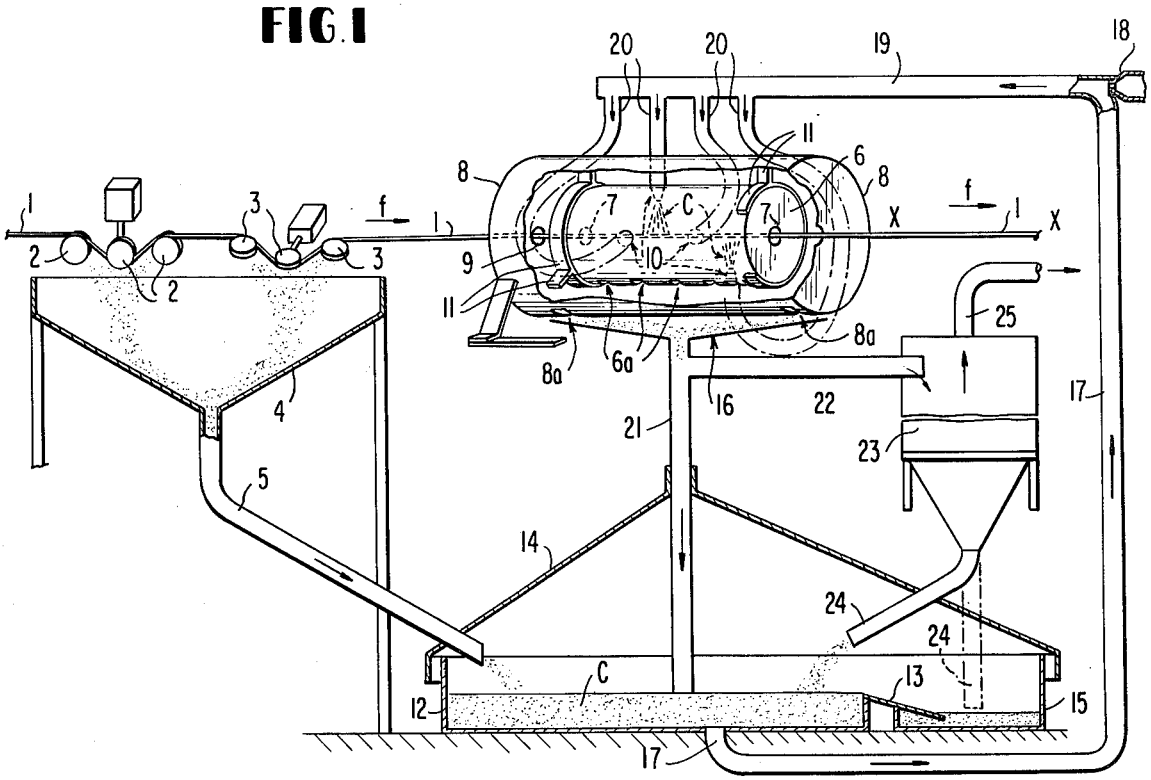
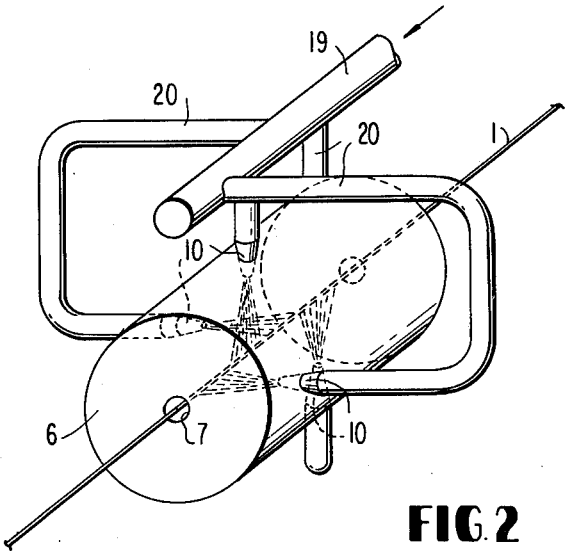
FIG. 2

PROCESS AND INSTALLATION FOR MECHANICAL DESCALING STEEL WIRE

The present invention relates to mechanical descaling of steel wire to obtain a "white" wire,, i.e., a wire whose outside appearance is brilliant and which is suitable for drawing.

Scale is an iron oxide produced on the surface of metal pieces undergoing high temperature treatment in contact with the air. Descaling occurs on a steel wire called "rod" after hot rolling and before drawing through dies.

A mechanical descaling process is known in the prior art consisting of making rod, which has just been hot rolled, followed by undergoing at least two bendings in two different directions, preferably in orthogonal planes. By itself, however, this process is not sufficient to descale completely.

A mechanical process is also known that following the preceding prior art type by using as an abrasive the scale recovered from the bent wire and by making the metal wire continuously go through a chamber where the wire receives projections of scale. This process is an improvement and has the advantage that the scale projection on the film does not damage its surface and the scale carried by the wire after treatment does not damage the dies. As a projected abrasive, the scale advantageously replaces abrasive sand conventionally used which, carried by the wire, rapidly wears out the dies, and also replaces iron shot that tends to hollow out craters in the wire and thus damages its surface.

The applicant has found that the projection of scale on the wire according to the prior art process mentioned above is not sufficient to clean the wire completely because the scale falling from the wire and recovered is not sufficient to treat the wire surface. Present rod, undergoing a forced cooling after rolling, comprises a scale tonnage between 4 and 6 kg of scale per ton of wire with a 6 mm diameter. The same ton of wire generally has a surface of 85 $m^2$. It is known that it is impossible to clean a surface of 85 $m^2$ with 6 kg of abrasive agent. A minimum of three times and preferably four times that much is required to obtain a correct sanding without excessive precautionary measures. The applicant has found that, by repeated recycling of the scale, the wire surface could be attacked starting with only the scale initially detached from the wire, and further has found that the scale, although considered fragile, since it breaks, fragments, and becomes powder, can be recycled. Generally for economy purposes, other abrasives that are more resistant and expensive such as sand are used, but this recycling of scale can be repeated several times, without losing effectiveness, with certain precautions.

The invention therefore has an object, a process for descaling metal wire of the type in which it is first made to undergo bendings to collect scale, in which this scale is projected inside an enclosure through which the wire passes. This process is characterized that the scale is projected several times on the wire by recycling the so-called used scale, i.e., the scale that has been projected at least once.

According to an important characteristic of the invention, the wire undergoes these projections of recycled scale several times during a single passage subjected to the scale projections.

The invention also has an object, the structural system for using this process, this system, of the type comprising a device for mechanical descaling by bendings followed by a descaling device with a chamber equipped with nozzles for projection of the scale in a compressed air current, and entry and exit holes through which the wire passes. The chamber comprises a scale tank connected to the descaling device by a recovery conduit and also connected to scale projection nozzles by aspiration, recycling and blowing conduits.

Other characteristics and advantages will be apparent from the following description of the drawings and the preferred embodiment.

In the accompanying drawing, given only by way of example:

FIG. 1 is a diagrammatic view, with a partial section of an installation according to the invention, FIG. 2 is a diagrammatic detail view in perspective showing the feeding of scale to the nozzles of the descaling chamber, FIG. 3 is a view similar to FIG. 1 of a modification of the installation shown in FIG. 1.

Referring now to FIGS. 1 and 2, an installation according to the invention is shown. It is intended to treat a metal wire 1 coming from a coil of rod, not shown, and moving continuously along its axis XX. The rod is at this point covered with scale.

The invention essentially comprises:

a bending device, a device for cleaning or "sanding" by projection of scale, a scale recycling circuit, on the recycling circuit, a device for selection or sorting of the scale particles.

It should be noted that although the term "sanding" is used here, there is, however, no question of the use of sand as an abrasive. The term is used in a generic sense for the use of scale. The term sanding is the only one descriptive for designating the operation of projection of abrasive (scale).

(1) Bending device:

As shown in FIG. 1, it comprises a first set of three rollers 2, in a plane, for example, vertical, and a second set of three rollers 3 in a plane, for example, horizontal, with the orientation of the plane of the first set of rollers 2 not being critical, however the plane of the second is set, in any case, at right angles to the first.

Placed under the set of rollers 2 and 3 is a hopper 4 acting as a receptacle to collect the scale. Hopper 4 is extended by a chute 5 feeding tank 12.

(2) Device for cleaning by "sanding" using projection of scale:

This comprises a sanding chamber 6 with axial entry and exit holes 7 for the passage of the metal wire. Chamber 6 has generally a cylindrical shape about axis X—X. According to the invention, its walls are preferably of a flexible material resistant to abrasion, such as, for example, urethane rubber. Chamber 6 has openings 6*a* in its lower part and is fastened, for example, by rigid collars 11 to braces on the inside of a protective casing 8, cylindrical and coaxial to chamber 6. Protective casing 8 is of a rigid material. It is also provided with axial openings 9 for entry and exit of metal wire 1. The axial openings 7 and 9 have wire guide rings or sleeves which, for reduction to essentials and clarity of drawing, have not been shown. Casing 8 has dimensions, both radial and longitudinal, considerably greater than those of descaling chamber 6 so as to provide, with chamber 6, a wide annular space. It is also possible to use a steel casing or chamber 8 with a flexible inside covering to be described herein as a variant of FIG. 3.

Casing 8 also serves for recovery and recycling of scale C in tank 12 and for this purpose is provided, on its cylindrical wall, with recycling openings 8*a* close to the entrance and exit, and in the intermediate space made with chamber 6. Through casing 8 pass nozzles 10 for projection of scale by blowing which come out inside descaling chamber 10. Preferably and according to the invention, nozzles 10 are arranged with an angular stagger in relation to one another, on the cylindrical periphery of chamber 6, and with a longitudinal staggering in relation to wire 1.

(3) Scale circuit—its recycling:

A scale storage tank 12 receives the so-called "new" scale directly from chute 5 below which it is placed. Tank 12 is connected by an adjustable overflow 13 with auxiliary tank 15 and is covered by a cover or hood 14 also covering auxiliary tank 15. The two tanks 14 and 15 are located below descaling device 6–8.

To feed scale to nozzles 10, a conduit 17 runs from the lower part of scale tank 12 and rises toward descaling device 6–8. In conduit 17, in the vicinity of descaling device 6–8, a compressed air injector 18 with a venturi tube protudes. Injector 18 is connected upstream to a compressed air source, not shown, under a pressure that is on the order of 4 to 7 bars and, for example, 4 to 5 bars, if it is desired to save energy. Conduit 17 is extended to a blowing conduit 19 coaxial with the venturi pipe of injector 18. The venturi also protrudes in the blowing conduit 19. Conduit 19 is subdivided into branches 20, for example four, connected directly to scale projection nozzles 10.

For the return or recycling of the scale, a container 16 is placed just below casing 8 and particularly having openings 8*a*. Receptacle 16 is extended by a descent or return conduit 21 having in the upper part a shunting branch 22.

(4) Scale selection and sorting device:

While conduit 21 descends directly toward scale storage tank 12, through hood 14,, the shunting branch 22 is connected to a cyclone 23 intended to sort or select the coarsest and heaviest scale particles. Branch 22 comes out tangentially in cyclone 23 provided in its lower part with a chute 24 for the heaviest scale particles. Chute 24 can be directed either toward main tank 12 or auxiliary tank 15. For this purpose, it comprises, as shown by the dotted arrow, a flexible sleeve that can be bent. In its upper part, cyclone 23 is surmounted by a dust evacuation stack 25.

OPERATION

With the aid of this installation, the process of the invention is practiced as follows:

As is known, metal wire 1 travels at a certain speed V in the direction of arrow f along axis X—X. Rod 2, unscaled, undergoes two bendings, by passing over the two successive sets of rollers 2 and 3 which break the layer of scale and make the wire lose part of scale C which is collected in receptacle 4. Via chute 5, the scale falls into main storage tank 12 from which it will feed nozzles 10 of abrasion descaling device 6–8. During the travel of wire 1, a part of the scale will fall in protective casing 8 before going into chamber 6 and it is collected by receptacle 16 through entry 8*a*. This is termed the so-called "new" scale.

According to the invention, the scale is aspirated into tank 12 by conduit 17 by the air suction created by venturi air injector 18. The scale rises to blowing conduit 19 and is propelled by air jet blown by injector 18 toward branches 20 and nozzles 10. The air speed is such that it forcefully projects the scale jets C spaced angularly and longitudinally on wire 1 which advances through descaling chamber 6 at a predetermined speed V in the direction of arrow f. There is a known relation between speed V of the advance of wire 1 and the length of sanding chamber 6. The higher speed V is, the more scale falls by chute 21. If speed V is increased, since nozzles 10 have a limited delivery, a greater number of nozzles 10 must be put in chamber 6 or else nozzles 10 with a larger diameter must be used. The length of sanding chamber 6 should be greater with an increase of the speed V of the advance of the wire. Scale jets C detach the scale that still adheres to wire 1. Because the jets are staggered angularly and longitudinally, the wire receives during its travel as many successive impacts of scale as there are nozzles 10, i.e., four in this particular example. After striking the wire, a part of the jet strikes the flexible wall of sanding chamber 6 and leaves a deposit on the bottom of the latter. This deposit flows into casing 8 via a lower opening 6*a*. A part of the projected scale is carried by the wire out of sanding chamber 6. The scale rapidly falls in casing 8 where a slight pressure prevails and is collected by exit 8*a* and receptacle 16 to fall into return conduit 21. At branch 22 of conduit 21 the scale is sorted with the heaviest and coarsest particles falling into tank 12 to be aspirated again by conduit 17 for reuse by nozzles 10. Thus, during the travel of the wire through descaling chamber 6, most of the scale, retaining a sufficient granulometry, is recycled several times. (Sorting of the scale starting with branch 22 will be explained below). Wire 1 is thus treated by nozzles 10 with a mass of scale that is a multiple of scale that would treat the wire by the same nozzles 10 if it were not for recycling. This is possible thanks to a suitable length of the sanding chamber 6 as a function of wire advance speed V.

In other words, during a single continuous pass of wire 1 through chamber 6, scale will pass and repass by nozzles 10, on the inside of chamber 6, as many times as the already used scale continues to be made up of particles sufficiently course to be effective. The smallest particles are eliminated by branch 22. Consequently, by this recycling of the scale, wire 1 is treated by projection of a mixture of new scale coming from chute 5 and the already used scale coming essentially from return conduit 21. This treatment mixture is quantitatively a multiple of the new scale mass initially detached from wire 1 during the bendings by the sets of rollers 2 and 3. It is also understood that a certain minimum volume of scale is initially needed in tank 12 to assure recycling. If the volume of scale dropped into tank 12 is important, the recycling of scale C is equally important. If this volume is slight, there is little recycling.

Wire 1, coming from casing 8, is white and silky, perfectly free of scale.

The sanding is so effective, as a result of this repeated recycling of scale, that it is even possible to introduce rusty wire up to a maximal proportion of 50% in relation to the unrusted scaled wire, and the amount of scale delivered by nozzles 10 with repeated recycling is sufficient to free the wire of its rust, without addition of new scale, since the rusted wire does not have it.

Without such repeated recycling, an incoming rusty wire would leave casing 8, after having passed under the four nozzles 10, without being freed of its rust.

Elimination of scale particles that are too small to be effective is performed, as known in itself, in the following manner: the stream generated by injector 18 escapes by branch 22 toward cyclone 23 carrying off the lightest scale particles. Yet certain coarse particles can be carried off. The finest particles or dust are immediately evacuated by aspiration to stack 25, while the minority of heavier particles fall by adjustable chute 24 either into auxiliary recovery tank 15 (position in broken lines) or into the main tank 12 (position in full lines), depending on the adjustment of chute 24.

Further, if tank 12 is full, the overflow vent 13 pours the excess scale into auxiliary tank 15.

Circulation of the scale in tanks 12 and 15 occurs protected from the air, under hood 14, which protects personnel from the dust.

As a result of the flexible wall of chamber 6, the scale particles that strike this wall can rebound in part without being broken into pieces, which enables a portion to be recycled. In other words, this flexible wall favors a total use of the scale and allows the unbroken particles to be recycled, to eventually strike wire 1 thereby contributing to its cleaning. Also, chamber 6 is much more resistant to abrasion and wear and more economical than a steel chamber.

As a result of the adjustable chute 24, main tank 12 can be filled if the addition of "new" scale by chute 5 is low, particularly during passage of a rusty wire. In this case, of course, it is possible to pour into tank 12 the contents of auxiliary tank 15 essentially made up of already used scale, therefore of smaller particles than those of the "new" scale brought by chute 5.

By way of example, the scale recycling process according to the invention makes it possible to descale a rod 1 of 6 mm in diameter with a mass of 15 to 20 kg of scale per ton of wire exhibiting a surface of b 85 $m^2$ passing through chamber 6, whereas, without recycling, but with the same projection nozzles 10, the same mass of rod 1 of the same diameter would be treated with only 4 to 6 kg of scale coming from disengagement from the rod during previous bendings, which would not allow the wire to be totally freed from its scale.

This example shows that already used scale can be recycled four times without losing its effectiveness, although its granulometry diminishes with each recycling and it is possible to work with a mass four times greater than that which is detached from the wire, without the external addition of scale.

Finally, with the arrangement of the nozzles 10, staggered angularly and longitudinally in relation to wire 1, the scale jets do not interfere with one another or neutralize one another, which increases effectiveness.

As shown in FIG. 3, instead of having a chamber 6 distinct from casing 8 and separated from it by an annular space, a cylindrical steel casing 8 is furnished on the inside of the chamber with a covering of flexible material *6b*. Nozzles 10 come out into the cavity of casing 8 which becomes the chamber or enclosure for sanding or descaling.

Also, instead of having a single conduit 17 for aspiration of scale in tank 12, a single venturi injector 18 and a single blowing conduit connected to each nozzle 10 by branches 20 as in FIG. 1, there are as many scale aspiration and feed conduits 26 as nozzles 10 and as many venturi injectors 18 as nozzles 10. Each injector 18 is connected upstream to a compressed air source by a pipe 27, and downstream directly to a nozzle 10. Each scale supply conduit 26 is located in the vicinity of the bottom of tank 12 to pick up the scale and come out at its other end at a right angle to injector 18. Thus, the scale supply to each nozzle 10 carried by a compressed air current is more regular, more uniform.

Further, the used scale is collected at the lower part of descaling enclosure 8 by an inclined pipe 28 connected to orifices *8a* by pipes 29.

The functioning is the same as in the FIG. 1 embodiment.

Of course descaling enclosure 8 with covering *6b* can be used in the FIG. 1 embodiment instead of chamber 6 and casing 8, independently of conduits 26 and injectors 18. The conduits 26 and injectors 18 can be used in the example of FIG. 1 instead of conduits 17 and 19, and in combination with flexible chamber 6 and its rigid casing 8, i.e., independently of the sanding enclosure 8 with flexible covering *6b* of the example of FIG. 3.

Moreover, although not shown, nozzles 10 can be three, six or eight. They can be arranged on a spiral which also permits longitudinal descaling in relation to wire 1, materalizing the axis of this spiral.

Finally, conduits 17, 19, 20, 21 and 26 can comprise rigid sections connected to flexible tubing.

What is claimed is:

1. In a process of removing iron oxide scale from steel rod, including the steps of bending said wire to cause a portion of said scale to be detached from said rod surface, collecting said scale so detached from said rod surface, and projecting collected scale against said rod at a point thereon downstream from the point where said bending occurs, the improvement comprising:

re-collecting said scale after it is projected against said rod;

removing from re-collected scale, scale particles below a predetermined size;

mixing said re-collected scale having scale particles above said predetermined size with scale which has not been projected against said rod; and projecting mixed projected and unprojected scale in an amount greater than the amount of scale originally detached from said rod against said rod at a point thereon downstream from the original point of detachment only said mixed scale being projected against said rod.

2. The process of claim 1 wherein the amount of projected mixed projected and unprojected scale is equal to at least three times said amount of scale originally detached.

3. Apparatus for removing iron oxide scale from steel wire comprising:

means for bending said rod to cause a portion of said scale to be detached from said rod surface;

means for collecting said scale to detached from said rod surface;

means for projecting collected scale against said rod at a point thereon downstream from the point where said bending occurs;

means for re-collecting said scale after it is projected against said rod;

means for removing from re-collected scale, scale particles below a predetermined size;

means for mixing said re-collected scale having scale particles above said predetermined size with scale which has not been projected against said rod; and means for projecting mixed projected and unprojected scale in an amount greater than the amount of scale originally detached from said rod against said rod at a point downstream from the original point of detachment only said mixed scale being projected against said rod.

4. The apparatus of claim 1 wherein the amount of projected mixed projected and unprojected scale is equal to at least three times said amount of scale originally detached.

5. Apparatus for descaling steel rod having a coating of iron oxide scale comprising in combination:

means for bending said rod to detach a portion of iron oxide scale;

a hopper positioned under said bending means for collecting scale which is detached by said bending means, a descaling chamber enclosure, said rod passing from said bending means through said descaling chamber, said descaling chamber having a rigid outer wall and a flexible inner wall and having at least one aperture through said outer and inner walls for permitting movement of scale therethrough;

a casing surrounding at least a portion of said descaling chamber for collecting scale from said descaling chamber;

a scale storage tank;

a first conduit directing scale collected in said hopper to said scale storage tank;

a second conduit for directing scale collected in said casing to said scale storage tank;

a plurality of nozzles located within said descaling chamber, the outlets of said nozzles being directed towards said wire from a plurality of directions;

a third conduit connecting said scale storage tank to said nozzles;

means for supplying compressed air for propelling scale conducted through said third conduit through said nozzles; and means coupled to said third conduit for removing scale particles having a size less than a predetermined minimum size, said predetermined size being such that scale collected in said hopper passes through said nozzles at least three times before being removed, only scale removed from said rod being passed through said nozzles.

6. The apparatus of claim 5 wherein said bending means comprises:

first and second sets of rollers having a plurality of rollers in each set, the rollers of each set lying in the same transverse plane, the transverse planes of said first and second sets of rollers being orthogonal to one another.

7. The apparatus of claim 5 further comprising Venturi means for coupling said compressed air to said nozzles.

8. Apparatus for descaling steel rod having a coating of iron oxide scale comprising in combination:

means for bending said rod to detach a portion of iron oxide scale;

a descaling station, said rod passing from said bending means through said descaling station, means for collecting scale from said bending means and said descaling station;

a plurality of nozzles located at said descaling station, the outlets of said nozzles being directed towards said rod from a plurality of directions, at least some of said nozzles being positioned in different planes;

means for moving scale from said collecting means through said nozzles, only scale removed from said rod being passed through said nozzles; and means coupled to said collecting means for removing scale particles having a size less than a predetermined minimum size, said predetermined size being such that scale collected in said collecting means passes through said nozzles a plurality of times before being removed.

9. The apparatus of claim 8 wherein said nozzles are staggered angularly in relation to each other.

* * * * *